US008347896B2

(12) United States Patent
Liao

(10) Patent No.: US 8,347,896 B2
(45) Date of Patent: Jan. 8, 2013

(54) ARTIFICIAL EYELASH STRUCTURE AND ITS FABRICATION AND METHOD OF USE

(76) Inventor: Chun-Wei Liao, Taichung (TW)

( * ) Notice: Subject to any disclaimer, the term of this patent is extended or adjusted under 35 U.S.C. 154(b) by 95 days.

(21) Appl. No.: 12/776,971

(22) Filed: May 10, 2010

(65) Prior Publication Data

US 2011/0232666 A1 Sep. 29, 2011

(30) Foreign Application Priority Data

Mar. 26, 2010 (TW) ..... 99109330 A

(51) Int. Cl.
*A41G 3/00* (2006.01)
*A41G 5/00* (2006.01)
*A45D 40/30* (2006.01)

(52) U.S. Cl. ..... 132/201; 132/216

(58) Field of Classification Search ..... 132/201, 132/216, 53–56
See application file for complete search history.

(56) References Cited

U.S. PATENT DOCUMENTS 1,810,566 A * 6/1931 Keney ..... 446/394
2,079,256 A * 5/1937 Kaiser ..... 132/53
3,447,542 A * 6/1969 McCullough ..... 132/53
3,559,657 A * 2/1971 Bau ..... 132/201
2002/0056465 A1* 5/2002 Shin ..... 132/53

* cited by examiner

*Primary Examiner* — Robyn Doan
(74) *Attorney, Agent, or Firm* — Muncy, Geissler, Olds & Lowe, PLLC

(57) ABSTRACT

An artificial eyelash structure includes a mounting member having a bonding portion for adhering to an eyelid and a bendable portion for enabling the bonding portion to be curved into a smoothly arched shape when bending the bonding portion upwards or downwards, and multiple eyelashes connected with the mounting member. The artificial eyelash structure is prepared by: forming a mounting member from a thin film, and then processing the thin film of the mounting member into a bonding portion and a bendable portion such that the bendable portion enables the bonding portion to be bent upwards or downwards, and then connecting eyelashes with the mounting member. A method of using an artificial eyelash structure includes the step of preparing an artificial eyelash structure having a mounting member and eyelashes connected with the mounting member, the step of bending the mounting member along the connection between the mounting member and the eyelashes to form a bonding portion; and the step of curving the bonding portion into a smoothly arched shape and then using a glue or double-sided adhesive to adhere the bonding portion to an eyelid.

7 Claims, 2 Drawing Sheets

ARTIFICIAL EYELASH STRUCTURE AND ITS FABRICATION AND METHOD OF USE

BACKGROUND OF THE INVENTION

1. Field of the Invention

The present invention relates to artificial eyelashes and more particularly, to the fabrication and use of an artificial eyelash structure.

2. Description of the Related Art

Regular artificial eyelash structures are commonly made in a smoothly arched shape for direct installation. However, because the curvatures of the eyelids of different people are different, it is difficult to attach or adhere a fixed shape of artificial eyelash structure to an eyelid. The user's eyelid may feel uncomfortable after mounting of an artificial eyelash structure.

Further, the eyelashes of most commercial artificial eyelash structures are adhered into place. The mounting procedures of the eyelashes of most commercial artificial eyelash structures are complicated and time-consuming. During fabrication, the eyelashes may fall out of place, affecting product yield rate and sense of beauty. Further, except complicated manufacturing procedure and expensive processing tools, the fabrication of conventional artificial eyelash structures much labor.

Therefore, improvements on the fabrication and use of conventional artificial eyelash structures are needed.

SUMMARY OF THE INVENTION

The present invention has been accomplished under the circumstances in view. It is the main object of the present invention to provide an artificial eyelash structure, which can be attached to an eyelid positively and smoothly in a convenient and rapid manner. It is another object of the present invention to provide an artificial eyelash structure, which facilitates diversified mass production in an economic way.

To achieve these and other objects of the present invention, an artificial eyelash structure comprises a mounting member having a bonding portion for adhering to an eyelid and a bendable portion for enabling the bonding portion to be curved into a smoothly arched shape when bending the bonding portion upwards or downwards, and multiple eyelashes connected with the mounting member.

Preferably, the mounting member is a narrow elongated thin strip.

Further, the eyelashes can be connected with the mounting member at the bendable portion or extending over the bendable portion.

To achieve these and other objects of the present invention, an artificial eyelash structure preparation method includes the steps of: a) forming a mounting member from a thin film, b) processing the thin film of the mounting member into a bonding portion and a bendable portion such that the bendable portion enables the bonding portion to be bent upwards or downwards, and c) connecting eyelashes with the mounting member.

Preferably, the mounting member and the eyelashes are made from one same thin film in integrity.

The artificial eyelash structure preparation method further comprises step d) bending the bonding portion of the mounting member upwards or downwards through an angle via the bendable portion after the step b) or the step c).

To achieve these and other objects of the present invention, an artificial eyelash structure using method includes the step of preparing an artificial eyelash structure having a mounting member and eyelashes connected with the mounting member, the step of bending the mounting member along the connection between the mounting member and the eyelashes to form a bonding portion; and the step of curving the bonding portion into a smoothly arched shape and then using an adhesive means to adhere the bonding portion to an eyelid.

Further, the mounting member provides a bendable portion for enabling the bonding portion to be bent upwards or downwards.

Further, the adhesive means can be a glue or double-sided adhesive.

DETAILED DESCRIPTION OF THE INVENTION

Figure 1:
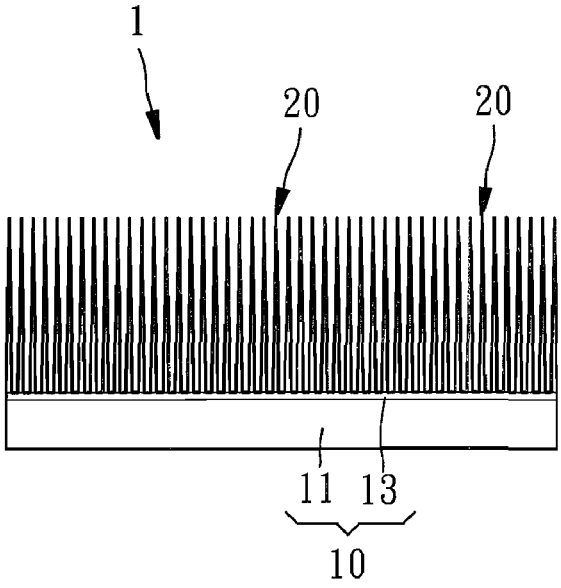
FIG. 1 is a top view of an extended status of an artificial eyelash structure in accordance with the present invention.
Figure 2:
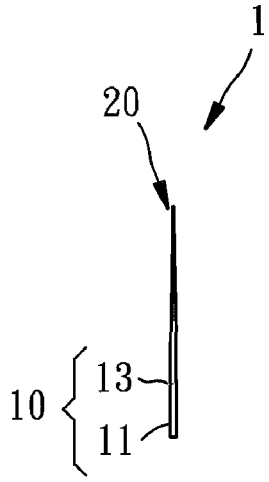
FIG. 2 is a side view of FIG. 1.
Figure 3:
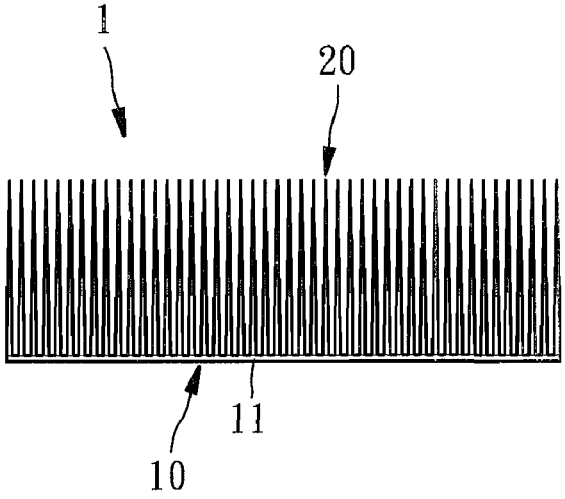
FIG. 3 corresponds to FIG. 1, showing the bonding portion of the artificial eyelash structure bent through 90-degrees.
Figure 4:
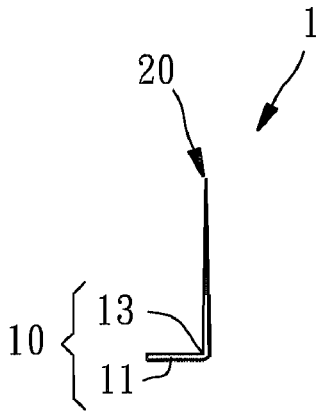
FIG. 4 is a side view of FIG. 3.

Other and further advantages and features of the present invention will be understood by reference to the following specification in conjunction with the accompanying drawings, in which:

the artificial eyelash structure 1 includes the upper eyelashes and the lower eyelashes;

the human eyelid includes the upper eyelid and the lower eyelid;

the eyelashes disclosed are not limited to real hair, artificial hair or hair-like object, and can be made of any material in any shape and size.

Referring to FIGS. 1-5, an artificial eyelash structure 1 comprises:

a mounting member 10 having a bonding portion 11 for adhering to an eyelid and a bendable portion 13 for enabling the bonding portion 11 to be curved into a smoothly arched shape when bending the bonding portion 11 upwards or downwards; and multiple eyelashes 20 connected with the mounting member 10;

wherein the mounting member 10 is a narrow elongated thin strip; the bendable portion 13 is a groove; the eyelashes 20 are extended out when the bonding portion 11 of the mounting member 10 is curved into a smoothly arched shape.

Further, the eyelashes 20 can be connected with the bendable portion 13 of the mounting member 10, or connected with the bonding portion 11 and extending over the bendable portion 13.

Figure 5:
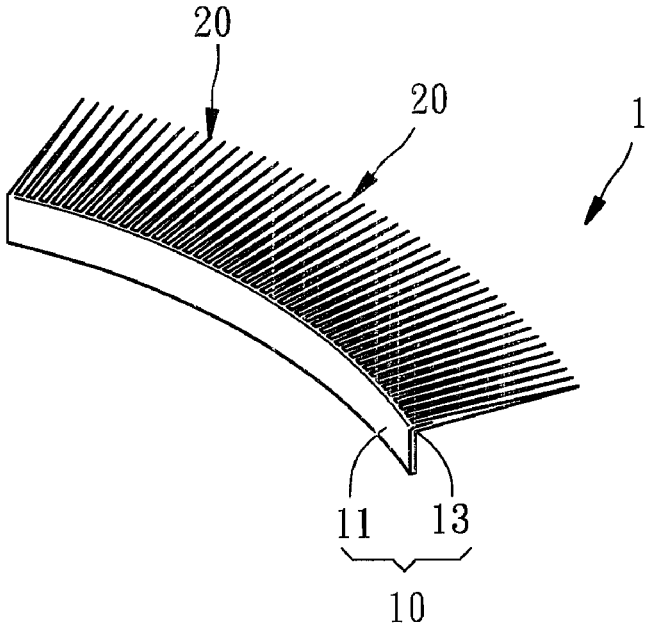
FIG. 5 is an oblique top elevation of the present invention, showing the bonding portion of the artificial eyelash structure curved into a smoothly arched status and the multiple pieces of hair extended out.

Thus, the bonding portion 11 can be curved to fit the curvature of the eyelid, as shown in FIG. 5, and attached to the eyelid smoothly.

An artificial eyelash structure preparation method in accordance with the present invention includes the steps of:

a) forming a mounting member 10 from a thin film;

b) processing the thin film of the mounting member 10 into a bonding portion 11 and a bendable portion 13 such that the bendable portion 13 enables the bonding portion 11 to be bent upwards or downwards; and c) connecting eyelashes 20 with the mounting member 10.

Subject to consumers' requirements, the invention further includes step d) bending the bonding portion of the mounting member 10 upwards or downwards through an angle via the bendable portion 13.

Figure 6:
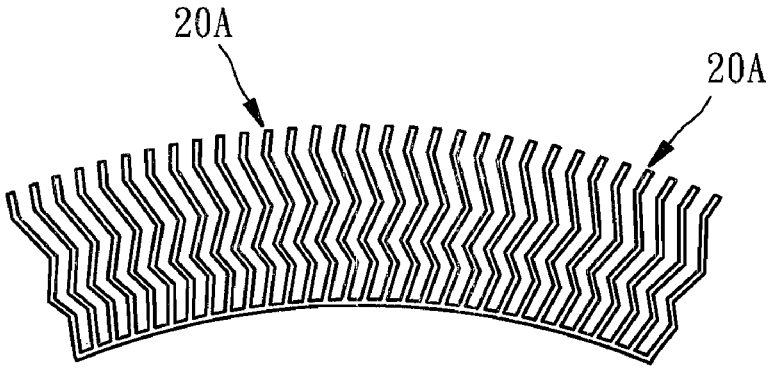
FIG. 6 is a top view of an alternate form of the artificial eyelash structure in accordance with the present invention.

Further, the mounting member 10 and the eyelashes 20 can be made from a same thin film (not shown) in integrity. Alternatively, the mounting member 10 and the eyelashes 20 can be made from different materials. The finished product can be made in any of a variety of other shapes. FIG. 6 shows an alternate form of the eyelash structure 20A in accordance with the present invention. According to all above said form, the eyelashes can be prepared from plastics, paper or cloth, and can be connected with the mounting member by fastening (not shown).

According to this preparation method, the mounting member 10 and the eyelashes 20 can be made rapidly, i.e., the invention is practical for diversified mass production.

Further, an artificial eyelash structure using method in accordance with the present invention includes the steps of:

a) preparing an artificial eyelash structure 1 having a mounting member 10 and eyelashes 20 connected with the mounting member 10;

b) bending the mounting member 10 along the connection between the mounting member 10 and the eyelashes 20 to form a bonding portion 11; and c) curving the bonding portion 11 into a smoothly arched shape and then using adhesive means to adhere the bonding portion 11 to an eyelid;

wherein the mounting member 10 provides a bendable portion 13 for enabling the bonding portion 11 to be bent upwards or downwards, i.e., the formation of the bendable portion 13 can be included in the artificial eyelash structure using method. Further, the adhesive means can be a glue or double-sided adhesive.

Subject to this artificial eyelash structure using method, a user can conveniently and freely curve the bonding portion 11, and then adhere the bonding portion 11 to the eyelid smoothly.

Further, in the aforesaid various examples of the present invention, the distal end of each of the eyelashes of the artificial eyelash structure can be curled.

Further, the bendable portion of the mounting member can be made in any of a variety of shapes, facilitating control of bending angle or positioning of the bonding portion relative to the bendable portion. Further, the lengths of the eyelashes can be gradually shortened from the middle part toward the two opposite lateral sides for shape fit. Further, the bendable portion is not limited to the aforesaid design of groove. It can be a cut, wrinkle, dent or any structure that facilitates bending of the bonding portion relative to the eyelashes.

In conclusion, by means of the description of the aforesaid various embodiments, the preparation and use of the artificial eyelash structure of the present invention are fully understood. The invention enables a user to attach an artificial eyelash structure to the eyelid positively and rapidly. Further, the invention facilitates diversified mass production of inexpensive artificial eyelashes.

The present invention having been thus described with particular reference to the preferred embodiments thereof, it will be obvious that various changes and modifications may be made therein without departing from the spirit and scope of the present invention as defined in the disclosure and the claims.

What is claimed is:

1. An artificial eyelash structure, which is made from one plane thin film as a unitary body, comprising:

a mounting member and multiple artificial eyelashes;

said mounting member, which is a narrow elongated thin strip, having a bonding portion for adhering to an eyelid and a bendable portion comprising a groove along which the mounting member is bent to form an angle between the bonding portion and the artificial eyelashes; and said artificial eyelashes initially extending from said bendable portion;

wherein the bendable portion enables the bonding portion to be subsequently curved into a smoothly arched shape, said shape resulting in the artificial eyelashes being extended apart.

2. The artificial eyelash structures as claimed in claim 1, wherein said mounting member and artificial eyelash are made from plane paper.

3. The artificial eyelash structures as claimed in claim 1, wherein said mounting member and artificial eyelash are made from plane plastic.

4. An artificial eyelash structure preparation method, comprising the steps of:

a) forming a mounting member and multiple artificial eyelashes from a plane thin film as a unitary body;

b) processing said thin film of said mounting member into a bonding portion for adhering to an eyelid and a bendable portion comprising a groove along which the mounting member is bent to form an angle between the bonding portion and the artificial eyelashes.

5. The artificial eyelash structure preparation method as claimed in claim 4, further comprising step d) bending said bonding portion of the mounting member to form an angle between the bonding portion and the artificial eyelashes.

6. A method of using an artificial eyelash structure, comprising the steps of:

a) preparing an artificial eyelash structure having a mounting member and multiple artificial eyelashes connected with said mounting member;

b) bending said mounting member along a bendable portion comprising a groove along which the mounting member may be bent to form an angle between said mounting member and said artificial eyelashes, thereby forming a bonding portion; and c) curving said bonding portion into a smoothly arched shape and then using adhesive means to adhere said bonding portion to an eyelid, said shape resulting in the artificial eyelashes being extended apart.

7. The method as claimed in claim 6, wherein said adhesive means is a glue or double-sided adhesive tape.

* * * * *